United States Patent [19]

Hirooka et al.

[11] 4,149,105

[45] Apr. 10, 1979

[54] FILAMENT-FIXING TERMINAL FOR A FLUORESCENT INDICATOR TUBE

[75] Inventors: Shikou Hirooka, Hyogo; Tetsuyoshi Mitsusono, Himeji; Takeshi Hashimoto, Hyogo; Katsuhiro Kusumoto, Himeji, all of Japan

[73] Assignee: Tokyo Shibaura Electric Co., Ltd., Kawasaki, Japan

[21] Appl. No.: 747,312

[22] Filed: Dec. 3, 1976

[30] Foreign Application Priority Data

Dec. 5, 1975 [JP] Japan ..... 50-164634[U]
Dec. 24, 1975 [JP] Japan ..... 50-175755[U]

[51] Int. Cl.[2] ..... H01J 1/18; H01J 63/02; H01J 63/06

[52] U.S. Cl. ..... 313/496; 313/257; 313/278

[58] Field of Search ..... 313/274, 496, 497, 278, 313/257

[56] References Cited

U.S. PATENT DOCUMENTS 3,736,455 5/1973 Rosallie et al. ..... 313/274
4,023,876 5/1977 Fukunaga et al. ..... 313/497 X

*Primary Examiner*—Palmer C. Demeo
*Attorney, Agent, or Firm*—Cushman, Darby & Cushman

[57] ABSTRACT

In a fluorescent indicator tube wherein a cathode filament is provided in an envelope at a prescribed space from anode segments arranged on a substrate, one end of said cathode filament is fixed to a plate-shaped cathode filament-fixing rigid terminal fitted to one end of the substrate, and the other end of said cathode filament is attached to a plate-shaped cathode filament-fixing resilient terminal secured to the other end of the substrate. The plate-shaped filament-fixing resilient terminal comprises a plate member capable of being resiliently deformed in the direction in which the cathode filament is stretched and a frame securely supporting said plate member and fitting the whole of the resilient filament-fixing terminal to the substrate. The forward section of the deformable plate member is made broader than the rear section. The resiliently deformable plate member is bent outward, that is, in a direction in which the cathode filament is stretched, in order to prevent the cathode filament from touching the free end of the deformable plate member. A cutout line extending lengthwise of the deformable plate member is provided in the broader section. That portion of this broader section which projects from the rear section is bent upward along the cutout line. When one end of the cathode filament is placed between the bent portion and flat portion of the forward section of the deformable plate member, then the bent portion is folded up and welded to the flat portion securely to put therebetween and clamp the cathode filament.

4 Claims, 7 Drawing Figures

FILAMENT-FIXING TERMINAL FOR A FLUORESCENT INDICATOR TUBE

BACKGROUND OF THE INVENTION

This invention relates to improvements on the filament-fixing terminal of a fluorescent indicator tube.

A fluorescent indicator tube generally comprises a substrate; a plurality of anode segments arranged on the substrate; a cathode filament stretched at a prescribed space from the anode segments; and a glass envelope which receives the anode segments and cathode filament in airtight condition. As is well known, the cathode filament of a fluorescent indicator tube is extremely fine and is linearly stretched with a certain tension between a very small rigid fixing terminal fitted to one end of the substrate and a similarly very small resilient fixing terminal secured to the other end of the substrate. The resilient fixing terminal is intended linearly to stretch the cathode filament with a proper tension. The resilient fixing terminal comprises a frame adapted to be fitted to the terminal-fixing strip of a fluorescent indicator tube and an resilient plate member, one end of which is attached to the frame member, and the other end of which is provided with the cathode filament-fixing portion of the fluorescent indicator tube and can be resiliently deformed in the direction in which the cathode filament is stretched, when the frame is mounted on the terminal-fixing strip.

Hitherto, the resilient plate member is bent inward, that is, in the direction in which a cathode filament is introduced when an resilient fixing terminal is secured to a substrate, thereby providing a flat portion to which the filament is to be fixed. Or the free end of said resilient plate member is simply fitted with another flat plate or rod member. With a prior art resilient fixing terminal provided with the above-mentioned cathode filament-fixing portion, an extremely fine cathode filament is liable to be broken after being set in place. Further, the conventional cathode filament fixing terminal has the drawback that the efficiency of mounting a cathode filament is low due to the difficulty of automation, resulting in an increased cost of a fluorescent indicator tube itself. This problem arises from the extremely small size of the cathode filament-fixing resilient terminal. For instance, where a cathode filament happens to touch burrs appearing at the end of a cathode filament-fixing resilient plate member while a fluorescent indicator tube is manufactured or when the tube vibrates per chance, then the cathode filament is often broken. This event takes place particularly where the cathode filament-fixing resilient plate member is bent inward. The cathode filament is electrically and mechanically connected to the resilient plate member when it is deformed under pressure. Since the cathode filament terminal has a small size as a whole, it is difficult to keep the resilient plate member of the terminal deformed under a predetermined pressure for stretching the cathode filament between above-mentioned fixing terminals. Hitherto, therefore, a cathode filament has failed to be efficiently mounted due to absence of a suitable jig.

SUMMARY OF THE INVENTION

It is accordingly an object of this invention to provide a fixing terminal for a fluorescent indicator tube, which is adapted for the firm fitting of a cathode filament.

Another object of the invention is to provide a cathode filament-fixing terminal for the fluorescent indicator tube which is so constructed as to prevent the easy breakage of cathode filament after set in place.

Still another object of the invention is to provide a cathode filament-fixing terminal for the fluorescent indicator tube which enables a cathode filament to be mounted firmly and quickly.

According to an aspect of the invention, there is provided a cathode filament-fixing terminal for a fluorescent indicator tube, which comprises a frame member adapted to be mounted on the substrate of the fluorescent indicator tube; and a resilient plate member, one end of which is secured to the frame member and the other end of which is provided with a cathode filament-fixing portion and resiliently deformed in the direction in which the cathode filament is stretched when the frame member is mounted on the substrate, wherein the cathode filament-fixing portion is formed by bending the resilient plate member in the same direction as that in which the cathode filament is stretched over the substrate of the filuorescent indicator tube

DESCRIPTION OF THE INVENTION

Figure 1:
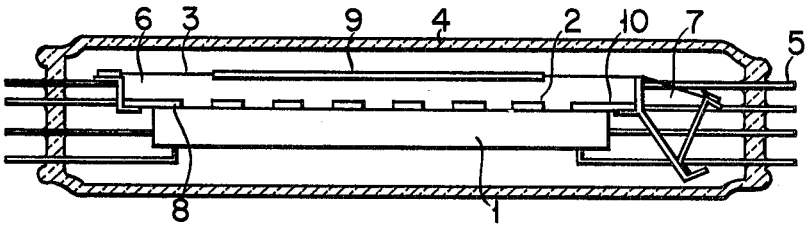
FIG. 1 is a schematic longitudinal cross sectional view of a round fluorescent indicator tube provided with a cathode filament-fixing terminal embodying this invention.

As seen from FIG. 1 schematically showing the longitudinal cross section of a tubular fluorescent indicator tube provided with a cathode filament-fixing terminal, the fluorescent indicator tube generally comprises a substrate 1; a large number of anode segments 2 arranged on the substrate 1; a cathode filament 3 spatially stretched over the anode segment 2; and a glass envelope 4 receiving the substrate 1 and cathode filament 3 in airtight condition. Since the glass envelope 4 has a tubular form and round cross section, a fluorescent indicator tube using said envelope 4 is referred to as a tubular type. A plurality of lead wires 5 electrically connected to the plural anode segments 2 and cathode filament 3 extend in airtightness from the interior of the glass envelope 4 through the end walls thereof to the outside.

The lead wires 5 concurrently act as electric connection lines for power supply and also as supports of, for example, this substrate 1. The substrate 1 is securely supported in the glass envelope 4 by being mechanically connected to the lead wires 5 extending fully through said glass envelope 4.

Figure 2:
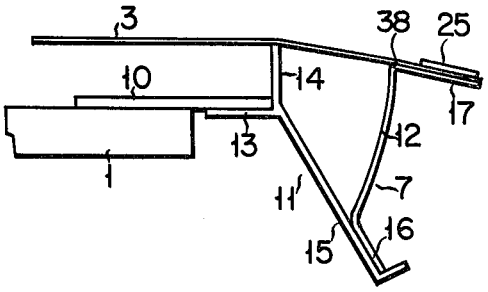
FIG. 2 is an enlarged side elevation of that part of the cathode filament fixing terminal which is fitted to the substrate of the tubular fluorescent indicator tube of FIG. 1.

The cathode filament 3 is stretched between a plate-shaped cathode filament-fixing rigid terminal 6 about 3 to 5 mm long fixed to one end of the substrate 1 and a plate-shaped cathode filament-fixing resilient terminal 7 about 4 to 6 mm long fitted to the other end of the substrate 1. The cathode filament-fixing rigid terminal 6 which is not readily deformed by a tension applied to the cathode filament 3 is, for example, welded to a terminal-fixing strip 8 firmly fitted to one end of the substrate 1. The cathode filament-fixing rigid terminal 6 is a substantially Z-shaped metal strip and has its height determined according to the distance at which the cathode filament 3 is spaced from the anode segments 2. The cathode filament-fixing resilient terminal 7 is constructed as shown in FIG. 2, is readily deformed under pressure, quickly regains its original shape upon release of an external force, and is, for example, welded to a terminal-fixing strip 10 fitted to the substrate 1 at the opposite end thereof to the cathode filament rigid fixing terminal 6. This cathode filament-fixing resilient terminal 7 comprises a frame member 11 having a substantially Y-shaped cross section and an arciform resilient strip 12 secured to the frame member 11. This Y-shaped frame member 11 comprises a flat portion 13 fixed to the terminal-fixing strip 10, a filament-supporting projection 14 extending right upward from said flat portion 13, and an extension 15 directed downward from a junction between the flat portion 13 and projection 14. The resilient strip 12 is bent upward and outward, starting with the upper end of a flat portion 16 contacting part of the downward directed extension 15. The upper part of the resilient strip 12 is horizontally bent outward substantially at right angles to constitute a flat portion 17 for mounting the cathode filament 3. With the foregoing embodiment, the above-mentioned cathode filament-fixing resilient terminal 7 is all formed of resilient material, for example, stainless steel. However, the whole of fixing terminal 7 need not be made of resilient plate material. Only the elastic strip 12 forming part of fixing terminal 7 may be prepared from resilient plate material. The filament-fixing flat portion 17 of the resilient strip 12 is formed by bending resilient plate material in a direction in which the cathode filament 3 is stretched so as to enable the cathode filament 3 to pass over the bent portion 38 of cathode filament-fixing flat portion 17 instead of being carried from the outermost end of flat portion 17, that is, the cut end of the resilient plate member at which bars often appear. Reference numeral 9 of FIG. 3 denotes electron emissive material deposited on the cathode filament.

Figure 3:
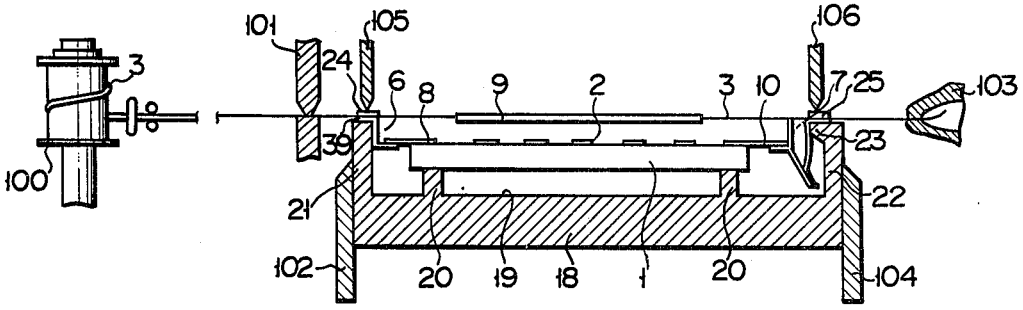
FIG. 3 schematically shows the cross section of a jig used in mounting a cathode filament, together with the cross section of the main part of a fluorescent indicator tube in the process of being manufactured.

There will now be described by reference to FIG. 3 the process of mounting the cathode filament 3. The cathode filament-fixing rigid terminal 6 and cathode filament-fixing resilient terminal 7 are fixed to the substrate 1. Then that part of the fluorescent indicator tube which is not provided yet with the cathode filament is held by a jig 18, as shown in FIG. 3. The jig 18 comprises projections 20, protruding from the bottom 19 of the jig 18, and walls 21, 22 which extent upward from the edge of the bottom 19 of the jig 18 to hold the cathode filament-fixing terminals 6, 7. The upper flat part of the wall 21 for holding the cathode filament-fixing rigid terminal 6 has a substantially flat plane to match the outline of cathode filament-fixing rigid terminal 6. The flat portion 39 of the cathode filament-fixing rigit terminal 6 abuts against the upper flat part of the wall 21. The upper part of the wall 22 for holding the cathode filament-fixing resilient terminal 7 is provided with an inward-projecting push portion 23. The distance between the mutually facing planes of the push portion 23 and the upper portion of the wall 21 is chosen to be slightly smaller than a lateral distance between both inner edges of the above-mentioned flat portions 39, 17 of the cathode filament fixing terminals 6, 7 when the body of the fluorescent tube is not held by the jig 18. When the body of the fluorescent indicator tube is held by the jig 18 as shown in FIG. 3, the push portion 23 pushes the resilient strip 12 of the cathode filament-fixing resilient terminal 7. As the result, resilient fixing terminal 7 is so deformed as to reduce the angle between the resilient strip 12 and frame member 11, namely reduce aforementioned intra-inner edges' distance.

While the body of the fluorescent indicator tube is held by the jig 18, one end of the cathode filament 3 is set on the filament-fixing flat plane 39 of the rigid filament-fixing terminal 6. A fixing terminal ribbon 24 is, for example, welded to flat plane 39 of the fixing terminal 6 with said one end of the cathode filament clamped therebetween. The cathode filament 3 is stretched over the substrate 1 to have the other end of filament 3 to be placed on the flat portion 17 of the cathode filament-fixing resilient terminal 7. Like the aforesaid one end, the other end of the cathode filament 3 is fixed in place by a terminal ribbon 25. When the body of the fluorescent indicator tube in which the cathode filament 3 has been securely set in place as described above is removed from the jig 18, the resilient strip 12 is expanded outward by a force with which the cathode filament-fixing resilient terminal 7 is going to regain its original shape. As the result, the cathode filament 3 is pulled lengthwise to be stretched over the anode segments 2. Since the cathode filament-fixing resilient terminal 7 has such a construction as is easily held by the jig 18 shown in FIG. 3, the cathode filament 3 is quickly stretched between the filament-fixing terminals 6, 7.

FIG. 3 further indicates other devices than the jig 18 which are adapted for automation of the process of fitting the cathode filament. There will now be described said devices suitable for automation of the cathode filament-fixing process. The cathode filament is wound about a spool 100. The forward end of the cathode filament 3 is pulled up to a filament-locating clamp 101. The whole surface of the cathode filament 3 is coated with electron emissive material 9. The electron emissive material 9 is taken off from part of the cathode filament 3 while passing between the spool 100 and cathode filament-locating clamp 101, that part of the cathode filament which is to be disposed at the filament-fixing terminal. The cathode filament-locating clamp 101 holds the cathode filament 3 so as to enable a chuck 103 to catch a cut end of cathode filament 3. The jig 18 can move downward together with cutters 102, 104 disposed on both end walls of the jig 18. Welding electrodes 105, 106 can move upward. When the jig 18, cutters 102, 104 are moved downward and the welding electrodes 105, 106 are lifted, the chuck 103 is drawn near the cathode filament-locating clamp 101 to catch the cathode filament 3 held thereby. When the cathode filament-locating clamp 101 releases the cathode filament 3, then the chuck 103 pulls the cathode filament 3 out of clamp 101. Thereafter, the jig 18 cutters 102, 104 and welding electrodes 105, 106 regain the original positions. The cathode filament 3 is stretched between the cathode filament-fixing terminals 6, 7 and fixed to these terminals by means of welding electrodes 105, 106. Unnecessary portions of the cathode filament 3 used in the entire process of manufacturing a fluorescent indicator tube are cut off by the cutters 102, 104. The above-mentioned devices (including the jig 18) shown in FIG. 3 enable the cathode filament to be set in place automatically and continuously.

Figure 4:
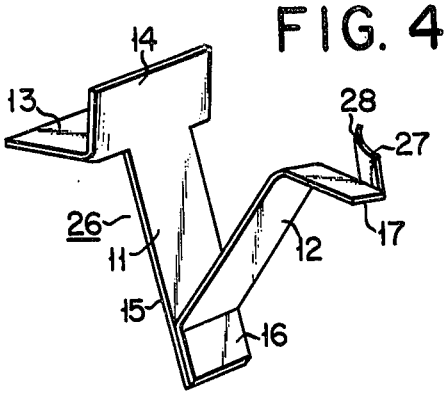
FIG. 4 is a schematic oblique view of a modification of the cathode filament-fixing terminal of FIG. 2 embodying this invention which is used with a fluorescent indicator tube.
Figure 5:
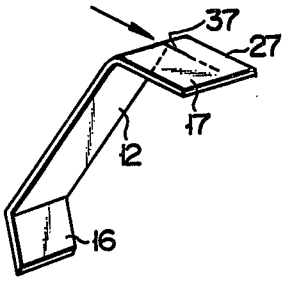
FIG. 5 is a schematic oblique view of a resilient strip forming part of the fixing terminal of FIG. 4.

There will now be described by reference to FIGS. 4 and 5, a modification of the cathode filament-fixing resilient terminal 7 of FIG. 2. A cathode filament-fixing resilient terminal 26 has substantially the same construction as that of FIG. 2. The parts of FIGS. 4 and 5 as those of FIG. 2 are denoted by the same numerals, description thereof being omitted. The resilient fixing terminal 26 has an outward bent elastic strip 12, the flat part 17 of which is made broader than the stem of bent resilient strip 12 to provide an integral upward folded porjection 27 as shown in FIG. 5. This projection 27 is formed by first forming a straight cutout line 37 extending lengthwise of the aforesaid outward bent resilient strip 12 in broader flat portion 17 and folding upward that part of broader flat portion 17 which projects from the stem of the bent resilient strip 12 along the cutout line as shown in FIG. 4.

That inner end of upward folded projection 27 which faces the end of the stretched cathode filament 8 is curved to provide a cathode filament guide 28 to prevent the cathode element from touching the inner free end of upward folded projection 27 on which burrs often appear. The cathode filament-fixing resilient terminal 26 which is provided with the upward folded projection 27 makes it unnecessary to provide a fixing terminal ribbon as is the case of the previously described embodiment of FIG. 3. The secure fitting of the cathode filament 3 is easily and quickly effected simply by bending downward upward folded projection 27 and, for example, welding the filament 3 between said projection 27 and flat part 17. Provision of the filament guide 28 prevents the cathode filament 3 from being broken by externally applied vibrations.

The foregoing description refers particularly to a cathode filament-fixing resilient terminal used with a tubular fluorescent indicator tube. However, the fundamental object of this invention is also applicable to a cathode filament-fixing resilient terminal used with a flat type fluorescent indicator tube.

Figure 6:
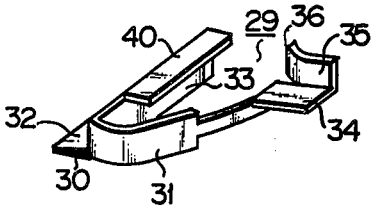
FIG. 6 is a schematic oblique view of another modification of the cathode filament-fixing terminal of this invention which is used with a fluorescent indicator tube.
Figure 7:
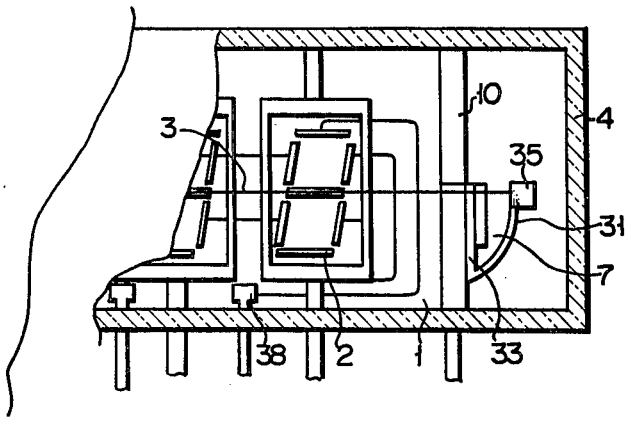
FIG. 7 is a fractional top view of a flat type fluorescent indicator tube provided with a cathode filament-fixing terminal shown in FIG. 6.

There will now be described by reference to FIGS. 6 and 7 a cathode filament-fixing resilient terminal used with a flat type fluorescent indicator tube. The parts of FIGS. 6 and 7 the same as those of FIGS. 1 to 5 are denoted by the same numerals. A cathode filament-fixing resilient terminal 29 of FIG. 6 used with a flat type fluorescent indicator tube comprises a frame member 30 having a substantially reverse Z-shaped cross section and an resilient strip 31 continuously extending therefrom. The reverse Z-shaped frame member 30 comprises a flat portion 32 which is to be fitted to a terminal-fixing strip 10 and a filament-supporting projection 33 extending upward from said flat portion 32 at right angles and having a flat portion 40 at the upper end. The resilient strip 31 extends from one end of filament-supporting projection 33 so as to be partly disposed parallel therewith. The other end of resilient strip 31 is provided with a cathode filament-fixing flat part 34 substantially horizontally parallel with the flat part 32 of the reverse Z-shaped frame member 30. This flat part 34 is provided with a upward folded projection 35, the inner end of which is curved to form a filament guide 36, as in the embodiment of FIG. 4. The reason why, unlike FIG. 2, the resilient strip 31 of the cathode filament-fixing terminal 29 extends crosswise from one end to the cathode filament-supporting projection 33 instead of being disposed on the underside of said projection 33 is that the fluorescent indicator tube of FIG. 5 has a flat construction.

The above-mentioned cathode filament-fixing resilient terminal 29 used with the flat type fluorescent indicator tube is located on the substrate 1 by means of a terminal-fixing strip 10 fixed thereto. The cathode filament 3 is set in place by the same process as described by reference to FIGS. 2 and 3.

With the flat type fluorescent indicator tube, lead wires 5 used with the tubular fluorescent indicator tube are replaced, as is well known to those skilled in the art, by lead strips 37 extending crosswise of the substrate 1, which are used for electrical connection between the anode segments 2, cathode filament 3, grid electrode and external circuit.

The cathode filament-fixing resilient terminals 7, 26, 29 of this invention can stretch a very fine cathode filament 3 over the substrate with a proper tension, and resiliently support filament 3 so as to keep it to have the predetermined proper tension when an electric current is supplied thereto for operating the fluorescent indicator tube and to prevent it from being easily broken even when external vibration are applied to the fluorescent indicator tube, whether it is of the tubular or flat type. As previously mentioned, the flat plate member of the cathode filament-fixing resilient terminals 7, 26, 28 of this invention is bent in a direction in which the cathode filament is stretched. Therefore the forward end of the introduced cathode filament 3 only touches the plate member and the bend thereof, but not the free end of the plate member. Even when, therefore, burrs appear at the free end of the plate member during manufacture of a fluorescent indicator tube, the cathode filament 3 is little liable to be broken by external vibrations applied to the indicator tube during or after production. Further, the cathode filament-fixing flat part which projects outward can be easily engaged with a jig, thereby enabling a cathode filament to be efficiently set in place, though the fixing terminal has a very small size.

What we claim is:

1. A fluorescent indication tube comprising:

(a) a substrate;

(b) a fluorescent display section including a plurality of anode segments arranged in a predetermined pattern on said substrate;

(c) a tension cathode filament stretched above said display section;

(d) a cathode filament fixing spring terminal including:

(i) a fixing portion disposed on one side of said substrate;

(ii) a spring-like plate member, one end of which is resiliently urged toward the fixing portion by said tension cathode filament and which has a flat part adapted to secure one end of the cathode filament and formed by bending the spring plate member away from that part of the substrate on which display segments are formed to produce a smooth edge joining said flat part to the rest of said plate member, said plate member having a surface extending in a plane which intersects the direction in which said filament is stretched so as to apply a force to stretch said filament;

(e) a cathode filament rigid terminal disposed on the other side of the substrate and the other end of the cathode filament for fixing said other end of said filament and (f) cover means hermetically sealed to enclose the fluorescent display section, the cathode filament and the spring terminal and having a transparent section for viewing said display section from outside.

2. A tube according to claim 1, wherein the fixing portion and the plate member are integrally formed of the same plate material.

3. A tube according to claim 1, wherein the fixing portion comprises a plate-like base portion, a flat portion provided on one side surface of the plate-like base portion and extending in a predetermined direction for attachment to the substrate and a cathode filament supporting projection which continuously extends from the flat part of the fixing portion and projects upward substantially at right angles from a plane including the substrate.

4. A tube according to claim 1, wherein the flat part of the fixing portion is provided with an integral upward folded projection fixing said cathode filament, said folded projection being formed by bending the flat part broader than the extending surface substantially in parallel to a cathode filament fixed to the flat part and being provided with a filament guide formed by cutting the folded projection partly along the bending line thereof and near the fixing portion and curving one end portion of the folded projection.

* * * * *